US005375685A

United States Patent [19]

Plath

[11] Patent Number: 5,375,685

[45] Date of Patent: Dec. 27, 1994

[54] ROLLING GARMENT BAG

[76] Inventor: Robert Plath, 501 Fairway Dr., Deerfield Beach, Fla. 33441

[21] Appl. No.: 106,391

[22] Filed: Aug. 11, 1993

[51] Int. Cl.[5] ..... A45C 5/14; A45C 13/04; A45C 13/28

[52] U.S. Cl. ..... 190/18 A; 206/287.1; 190/108; 190/115; 280/37

[58] Field of Search ..... 206/287.1, 279; 190/18 A, 115, 18 R, 108; 280/37, 655, 655.1, 39, 47.18

[56] References Cited

U.S. PATENT DOCUMENTS

| | | | |
|---|---|---|---|
| 2,985,266 | 5/1961 | Pelavin | 206/287.1 X |
| 3,122,225 | 2/1964 | Ward | 190/108 |
| 3,126,076 | 3/1964 | Koffler | 206/287.1 |
| 3,542,170 | 11/1970 | Bialo | 206/287.1 X |
| 4,062,429 | 12/1977 | Tabor et al. | 190/18 A |
| 4,081,061 | 3/1978 | Tucker | 190/108 |
| 4,087,102 | 5/1978 | Sprague | 190/18 A X |
| 4,262,780 | 4/1981 | Samuelian | 190/18 A |
| 4,406,353 | 9/1983 | Walker | 190/18 A |
| 4,411,344 | 10/1983 | Walker | 190/18 A |
| 4,436,189 | 3/1984 | Baum | 190/108 |
| 4,442,927 | 4/1984 | Walker | 190/18 A |
| 4,538,709 | 9/1985 | Williams et al. | 190/18 A |
| 4,618,035 | 10/1986 | Mao | 190/18 A |
| 4,647,056 | 3/1987 | Baker | 190/18 A X |
| 4,693,345 | 9/1987 | Mittelmann | 190/108 |
| 4,756,394 | 7/1988 | Cohen | 190/18 A |
| 4,761,012 | 8/1988 | Dames | 190/18 A X |
| 4,887,751 | 12/1989 | Lehman | 190/18 A X |
| 4,927,014 | 5/1990 | Pulichino, Jr. | 206/287.1 |
| 4,998,603 | 3/1991 | Nordstrom | 190/18 A |
| 5,054,589 | 10/1991 | Bomes et al. | 190/18 A |
| 5,105,920 | 4/1992 | Grebenstein | 190/18 A |
| 5,113,982 | 5/1992 | Pulichino et al. | 190/18 A |
| 5,209,327 | 5/1993 | Wright et al. | 190/18 A |
| 5,209,328 | 5/1993 | Kotkins, Jr. | 190/18 A |

FOREIGN PATENT DOCUMENTS

| | | | |
|---|---|---|---|
| 2641172 | 7/1990 | France | 190/18 A |
| 2359229 | 6/1975 | Germany | 190/18 A |

*Primary Examiner*—Sue A. Weaver
*Attorney, Agent, or Firm*—Jones & Askew

[57] ABSTRACT

A wheeled assembly that is removably attachable to a garment bag. The wheeled assembly is affixed to the folded garment bag with a zipper. The wheeled assembly is tilted forward and the attached garment bag rides on the wheeled assembly. Both the wheeled assembly and the garment bag have rigid structural features to provide the structural integrity needed to roll the garment bag. The wheeled assembly has a retractable handle that telescopes upward so that a user can pull the rolling garment bag.

8 Claims, 3 Drawing Sheets

ROLLING GARMENT BAG

TECHNICAL FIELD

The present invention relates to luggage and, more particularly, to a garment bag provided with a detachable wheel and handle assembly for rolling the garment bag.

BACKGROUND OF THE INVENTION

Originally, luggage consisted of a suitcase or duffel bag and perhaps a small "travel bag". These structures allowed many items to be stored in one portable structure.

However, both suitcases and duffel bags suffer from the fact that they are basically large receptacles into which clothing is dumped. Because of their size and shape, certain clothes, especially formal clothes such as suits and dresses, are not easily transported in a suitcase or duffel bag. Suits and dresses placed in a suitcase will almost invariably be wrinkled by both the folding of the clothes to fit within the suitcase and by the shifting of clothes within the suitcase. Travelers must then spend time and money pressing these clothes to remove the wrinkles.

To overcome this problem, garment bags were developed. Garment bags are elongate soft-sided bags. A hook extending from the top of the bag allows the bag to be hung. Suits, shirts and dresses are placed inside the bag and hung from hangers that are affixed to the top of the bag. The clothes hang freely within the elongate garment bag, and therefore are not wrinkled. The garment bag is narrow in width to preclude the clothes from shifting within the bag during transport.

Of course, easy portability is a primary concern for any piece of luggage. However, garment bags are long, which makes it inconvenient to carry them by holding the top of the bag. To enhance portability, garment bags can be and usually are folded in half lengthwise, and carried using a handle that extends upward from the garment bag when it is folded. The clothes hanging within the garment bag are also folded lengthwise when the garment bag is folded. Experience has shown that this one fold does not cause significant wrinkling of the garments.

Garment bags have become standard luggage for many travelers, especially business travelers, because they reduce the extent to which clothes become wrinkled during transport. Indeed, the conventional garment bag has evolved into more than just a suit or dress holder. Garment bags today have pockets for shoes, toiletries and other foldable clothes. For many business travelers, the garment bag has entirely replaced the suitcase.

The broadened utility of garment bags has significantly increased the weight of the typical packed garment bag. Garment bag weights have increased in weight as items other than hanging clothes are stored in the garment bag. However, methods for transporting the increased weights now associated with garment bags have not improved in conjunction with the new utilities of the bag. Garment bags are still transported by a handle or a shoulder strap extending from the top of the folded garment bag. For travelers walking a long way, or for elderly or handicapped travelers, carrying a heavy garment bag is an onerous task.

Putting wheels on suitcases is known in the art as a means for improving the portability of the luggage.

However, because of their soft, flexible nature, most garment bags are poor candidates for wheeled transport. If a soft, flexible garment bag is strapped onto a wheeled carrier, the bag sags or folds. When the sagging or folded bag is strapped onto the wheeled assembly, the clothes inside the bag are wrinkled and folded.

Accordingly, a need yet exists for easily transportable luggage for transporting formal garments without wrinkling the garments.

SUMMARY OF THE INVENTION

The present invention solves the above-identified problems in the art by providing a garment bag that is transportable on wheels.

Briefly described, the present invention is a wheeled assembly that is removably attachable to a garment bag. The wheeled assembly has a retractable handle that telescopes upward so that a user can pull the garment bag, and the garment bag rolls on two wheels depending from the wheeled assembly. The wheeled assembly acts like a dolly in carrying the garment bag.

More particularly described, the garment bag of the present invention has U-shaped stiffeners positioned along the top and bottom panels. When the garment bag is folded in half, these stiffeners provide structural rigidity that permits the garment bag to stand upright.

The wheeled assembly is detachably affixed to the front lower portion of the garment bag by a zipper. Two wheels depend from the wheeled assembly, protruding slightly below the bottom panel of the garment bag. When the retractable handle is extended and the user pulls the garment bag behind them, the garment bag rolls on the wheels.

The wheeled assembly can readily be removed from the garment bag by unfastening the zipper. Thus, if the user wants to carry the garment bag and avoid the weight associated with the wheeled assembly, the wheeled assembly is simply removed. Additionally, a pocket assembly is provided. The pocket assembly may be zippered to the garment bag in place of the wheeled assembly if the traveler wants to carry the garment bag. The pocket assembly provides additional storage space.

Further, the garment bag retains a narrow profile, regardless of whether the wheeled assembly or the pocket assembly is attached. This feature is critical to airline travel, allowing the rolling garment bag of the present invention to be stored in the overhead carry bin of an airplane.

The rolling garment bag has the flexibility and structure required for carrying formal garments. However, enough structural rigidity is supplied so that the garment bag may be wheeled.

Accordingly, it is an object of the present invention to provide an improved garment bag.

It is a further object of the present invention to provide a garment bag that may be transported by rolling the garment bag.

It is a further object of the present invention to provide a garment bag that has a detachable wheeled assembly that may be affixed to the garment bag if the user wants to transport the garment bag on wheels, and that may be removed if the user wants to carry the garment bag and avoid the weight associated with the wheeled assembly.

It is a further object of the present invention to provide a garment bag to which a pocket assembly may be attached when the wheeled assembly is not attached to the garment bag.

Other objects features and advantages of the present invention will become apparent upon review of the following detailed description of embodiments of the present invention when taken in conjunction with the drawings and appended claims.

DETAILED DESCRIPTION

Figure 1:
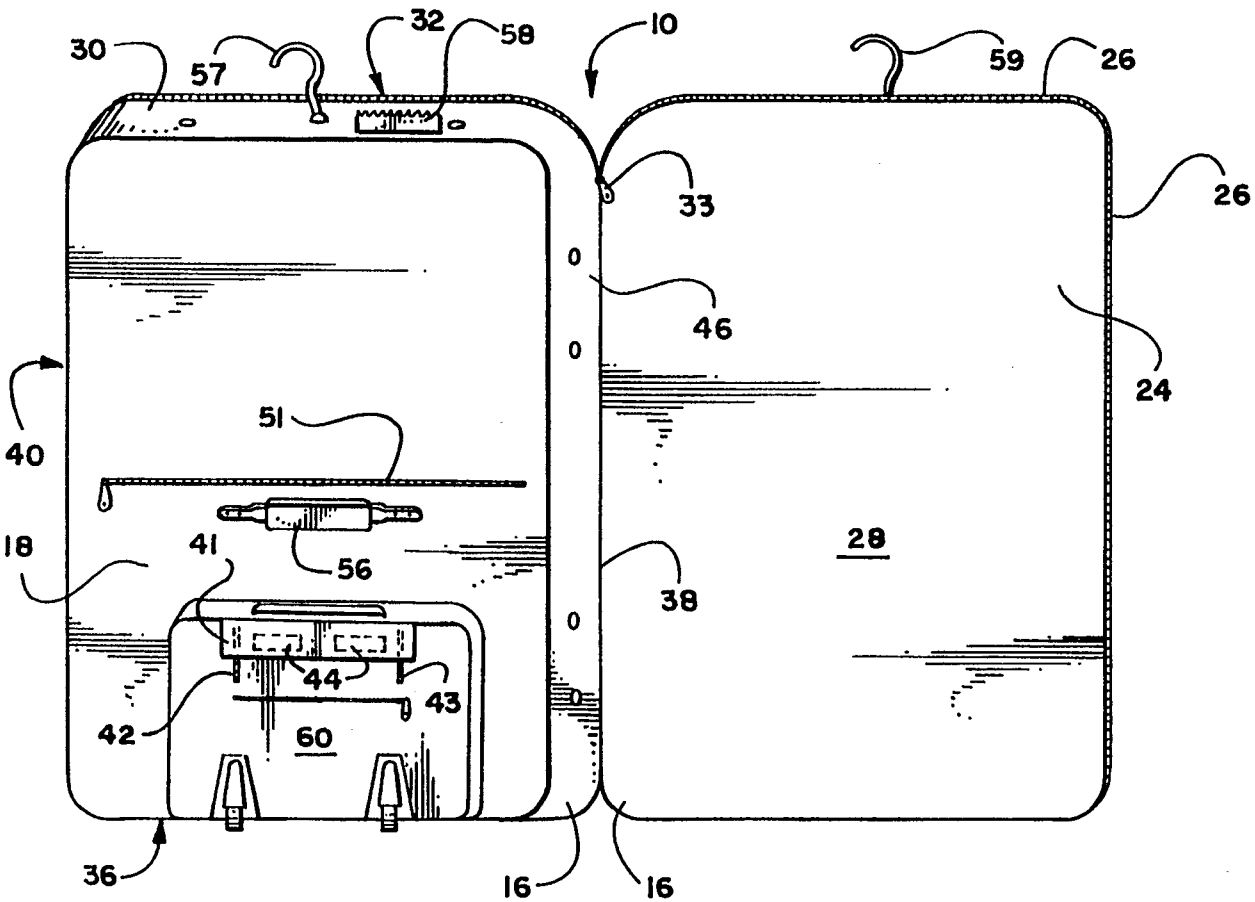
FIG. 1 is a perspective view of the preferred embodiment of the present invention, with the rolling garment bag opened.

Refer now to the Figures in which like referenced numerals correspond to like parts throughout the several views. FIG. 1 is a perspective view of the preferred embodiment of the present invention, with the rolling garment bag 10 opened. The rolling garment bag 10 comprises a garment bag 16 and a wheeled assembly 60 removably attachable to the garment bag 16.

The garment bag 16 has a front panel 18 and a rear panel 24, a top panel 30 and a bottom panel 36, and two side walls 40 and 46. The front panel 18 is sewn to the top panel 30, bottom panel 36, and side walls 40 and 46. The panels, 18, 24, 30, 36, and walls 40 and 46, are manufactured of 900 D Polyester with two-time PU coating manufactured by E.I. DuPont de Nemours Corp. Those skilled in the art will recognize that the panels may be formed of different materials, including various durable cloths, and that the front panel 18, top panel 30, bottom panel 36, and side walls 40 and 46 may be formed of one piece of material. A conventional zipper 51 and associated pocket are shown on panel 18. Those skilled in the art will recognize that other pockets may be placed on the panels and/or inside the garment bag.

The rear panel 24 is sewn to the right side wall 46 along edge 38. Zipper teeth 26 circumscribe the remaining three sides of the rear panel 24. Zipper teeth 26 correspond to zipper teeth 32 on top panel 30, side wall 40 and bottom panel 36. When the zipper teeth 26 and 32 are mated using sliding fastener 33, the garment bag 16 is closed. A hanger hook 59 extends upwardly from rear panel 24. Zipper teeth 26 and 32 are formed of #9 Decathlon Plastic Tooth (YKK), manufactured by in the preferred embodiment.

On the other hand, when zipper teeth 26 and 32 are disengaged, as seen in FIG. 1, the rear panel 24 may be swung about edge 38. Therefore, the user has access to the interior of the garment bag 16 using zipper teeth 26 and 32. Further, the garment bag may be hung by hangers 57 and 59 when in an open position.

Figure 2:
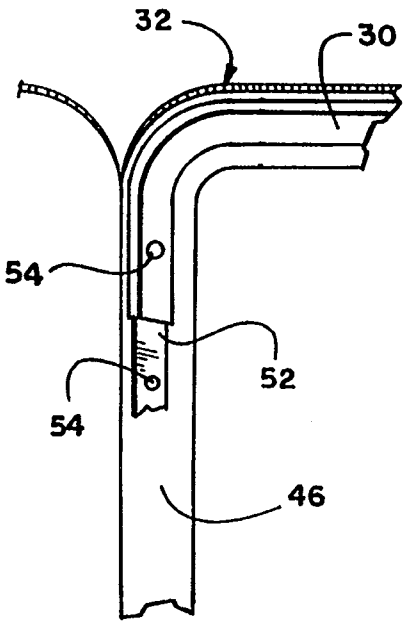
FIG. 2 is a perspective view of the side wall and top panel of the preferred embodiment of the present invention.

FIG. 2 is a perspective view of the side wall 46 and top panel 30 of the preferred embodiment of the present invention. Zipper teeth 32 are sewn along the edge of the top panel 30.

A stiffener 52 is attached to top panel 30 and partially down side walls 40 and 46. The stiffener 52 is a U-shaped piece of PVC material. Rivets 54 connect the stiffener 52 to the garment bag 16 along top panel 30 and downward along side walls 40 and 46 approximately 14". A second U-shaped stiffener 53, corresponding in structure to stiffener 52, is rivoted to the bottom panel 36 of the garment bag 16. The second stiffener 53 extends upward into side walls 40 and 46 approximately 1441, and is rivoted to the side walls 40 and 46. The stiffeners 52 and 53 provide rigidity to the frame of the garment bag 16. Those skilled in the art will recognize that the stiffeners 52 and 53 may be affixed to the garment bag 16 in a variety of manners. The stiffeners 52 and 53 are made of polyvinyl chloride, although those skilled in the art will recognize that other materials may be utilized.

Figure 3:
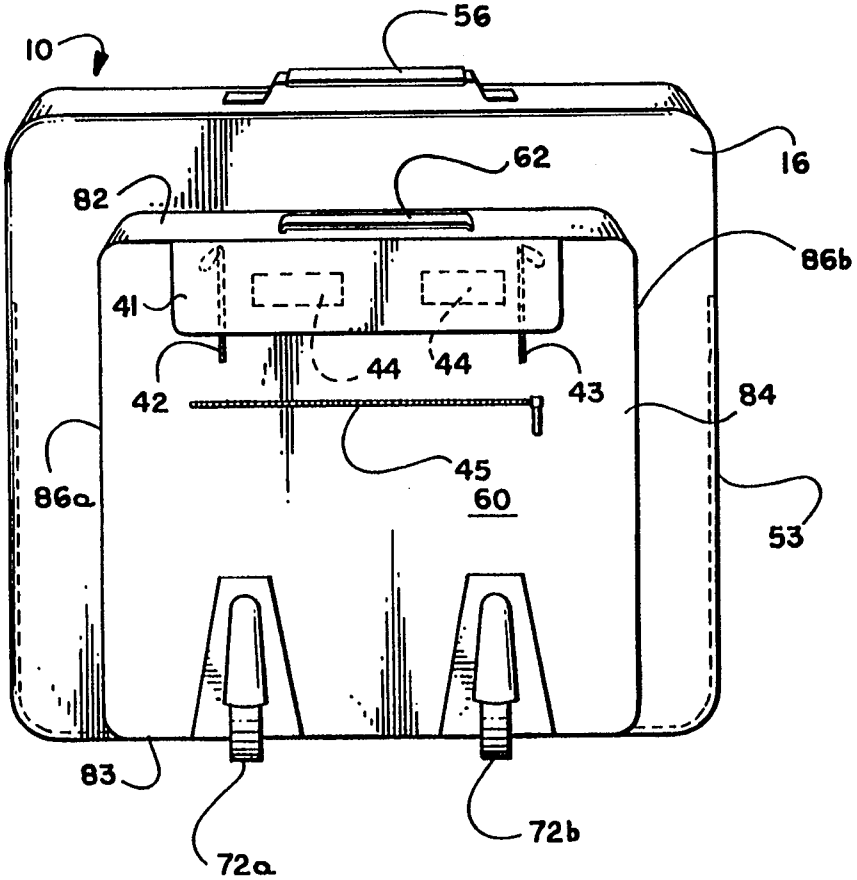
FIG. 3 is a perspective view of the preferred embodiment of the rolling garment bag ready for transport.

The stiffeners 52 and 53 extend 14" into side walls 40 and 46 so that the horizontal center of the garment bag 16 is pliable. Therefore, the garment bag 16 may be folded about a horizontal line running through handle 56 (FIG. 3). When the garment bag 16 is folded in half, the stiffeners 52 and 53 allow the bag 16 to stand-up.

Referring back to FIG. 1, a bag hanger hook 57 is rivoted to stiffener 52 on top panel 30. A zippered pocket 58 is positioned immediately adjacent the hook 57. The pocket 58 is large enough to hold hook 57. Therefore, when the hook 57 is not in use it can be stored in pocket 58.

FIG. 3 is a frontal view of the preferred embodiment of the rolling garment bag 10 folded and ready for transport. Handle 56 protrudes upward so the traveler may lift and carry the rolling garment bag 10.

The wheeled assembly 60 is affixed to the front of the rolling garment bag 10. The wheeled assembly 60 includes a top surface 82, a bottom surface 83, a front surface 84 and side surfaces 86*a* and *b*. The wheeled assembly 60 is made from the same material as front panel 18 in the preferred embodiment.

A rigid frame formed of stiffeners 68 (FIG. 4) circumscribes the interior of the wheeled assembly 60. The stiffener frame 68 provides a rigid frame for the wheeled assembly 60.

A retractable handle 62 extends from the top surface 82 of wheeled assembly 60. The handle 62 may be pulled upward and fixed into position so that the user can pull the rolling garment bag 10 using wheels 72*a* and *b*. Wheels 72*a* and *b* are known to those skilled in the art.

Wheels 72*a* and *b* protrude from the bottom surface 83 of the wheeled assembly 60. Wheels 72*a* and *b* protrude below the bottom panel 36 of the garment bag 10, so that the rolling garment bag 10 may be rolled on wheels 72*a* and *b*. The user can roll the rolling garment bag 10 by pulling on retractable handle 62 to urge the rolling garment bag in a direction aligned with the wheels 72*a* and *b*.

The preferred embodiment of the rolling garment bag 10 has a relatively narrow width. Therefore, the rolling garment bag 10 may be stored in the overhead bin of an airliner, obviating the need to check the rolling garment bag 10.

Folding flap 41 is made of the same material as wheeled assembly 60. Velcro connections 44, familiar to those skilled in the art, disengagingly affix flap 41 to the wheeled assembly 60. Lowering the zippers 42 and 43 allows easier access to the contents of wheeled assembly 60 when flap 41 is raised. As will be familiar to those skilled in the art, many pockets or attachments, such as zippered pocket 45, may be provided on wheeled assembly 60.

Figure 4:
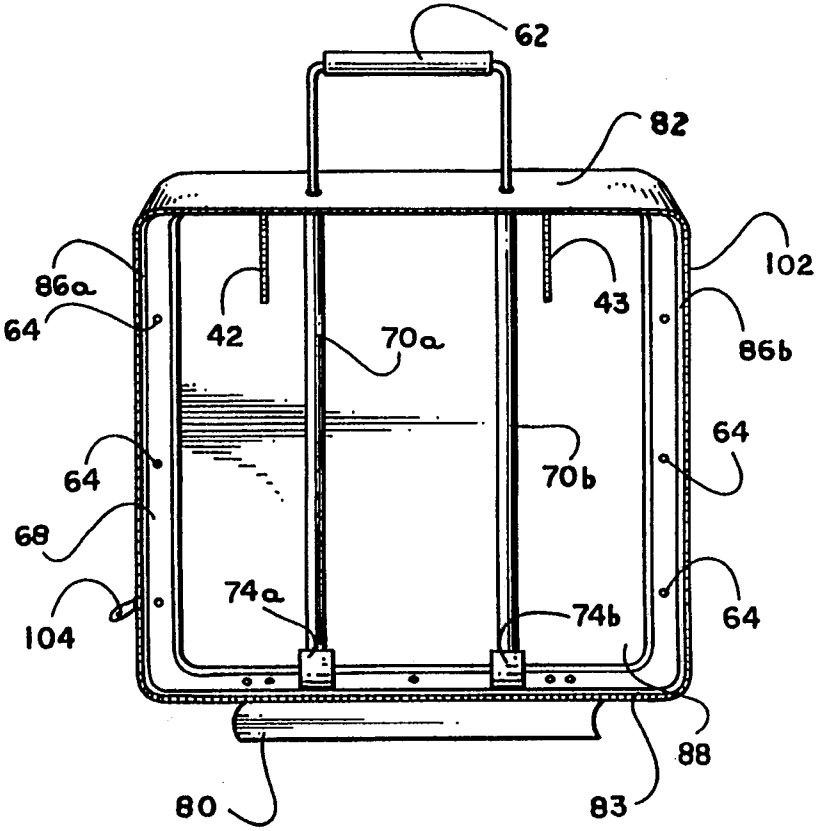
FIG. 4 is a rear view of the wheeled assembly.

FIG. 4 is a rear view of the wheeled assembly 60. Stiffener frame 68 is attached to the wheeled assembly 60 by a plurality of rivets 64. The wheeled assembly 60 has an open face 88 that is closed by affixing the wheeled assembly to the garment bag 16.

Handle 62 on top surface 82 of the wheeled assembly 60 is shown partially extended. Handle 62 telescopes into tubes 70*a* and *b*. An interference fit between handle 62 and tubes 70*a* and *b* allows the handle to be extended and fixed in a variety of positions. Those skilled in the art are familiar with such interference fit mechanisms.

Tubes 70*a* and *b* extend from top surface 82 of the wheeled assembly 60 to the wheel casings 74*a* and *b*. The rigid handle 62 and tubes 70*a* and *b* provides support under the garment bag 16 when the user tilts the garment bag 16 forward and rolls the assembly forward.

Wheels 72*a* and *b* are rotatably bolted to wheel casings 74*a* and *b*. Wheel casings 74*a* and *b* are rigid covers affixed to the axles of wheels 72*a* and *b* and precluding the contents of the wheeled assembly 60 from contacting wheels 72*a* and *b*.

Support plate 80 is riveted to the bottom surface of the wheeled assembly 60. The support plate 80 is inserted into an opening 90 (FIG. 5) in the bottom of the garment bag 16 to provide support under the garment bag 16 during transport. The support plate 80 further provides leverage when the garment bag 16 is pivoted onto the wheeled assembly 60 for transport. The support plate is of polyvinyl-chloride (PVC) in the preferred embodiment.

Figure 5:
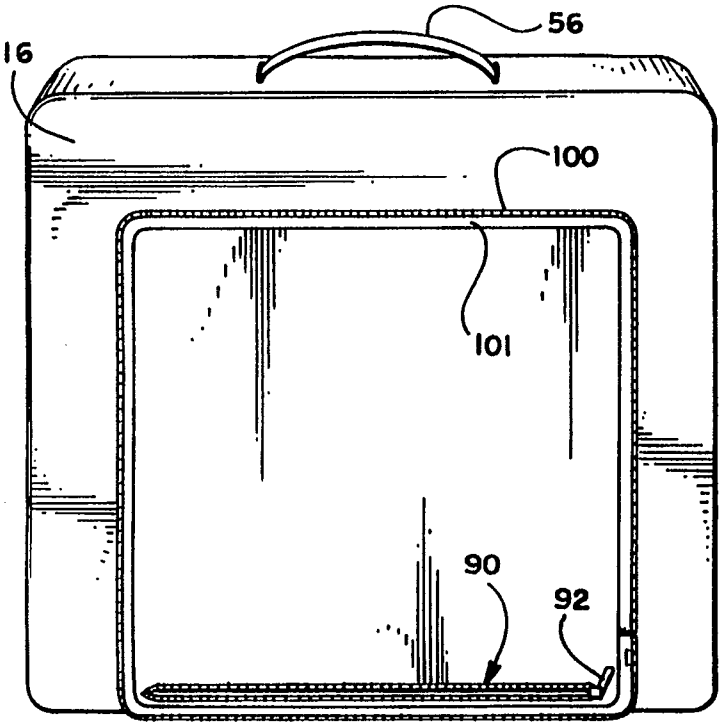
FIG. 5 is a frontal view of the garment bag without the wheeled assembly.

FIG. 5 is a frontal view of the garment bag 16 with the wheeled assembly 60 unattached. Zipper teeth 100 circumscribe the lower region of the front panel 18 of the garment bag 16. Zipper teeth 102 circumscribing the open face 88 of the wheeled assembly 60 correspond to zipper teeth 100 on the garment bag 16 (FIG. 4). Slidable connector 104 on the wheeled assembly 60 permits zippers 100 and 102 to be connected and disconnected. Further, zipper teeth 100 are sewn onto a protruding lip of material 101 that facilitates connecting zipper teeth 100 and 102. The wheeled assembly 60 may be detachably affixed to the garment bag 16 by mating sliding connector 104 with zipper 100, as is familiar to those skilled in the art. Attaching wheeled assembly 60 to the garment bag closes open face 88.

A zippered opening 90 is located on the bottom of the garment bag 16. Zipper 92 is retracted, creating an opening, when the wheeled assembly 60 is to be mounted on the garment bag 16. The support plate 80 on the bottom of the wheeled assembly 60 extends into the zippered opening 90 when the wheeled assembly is mounted on the garment bag 16.

Figure 6:
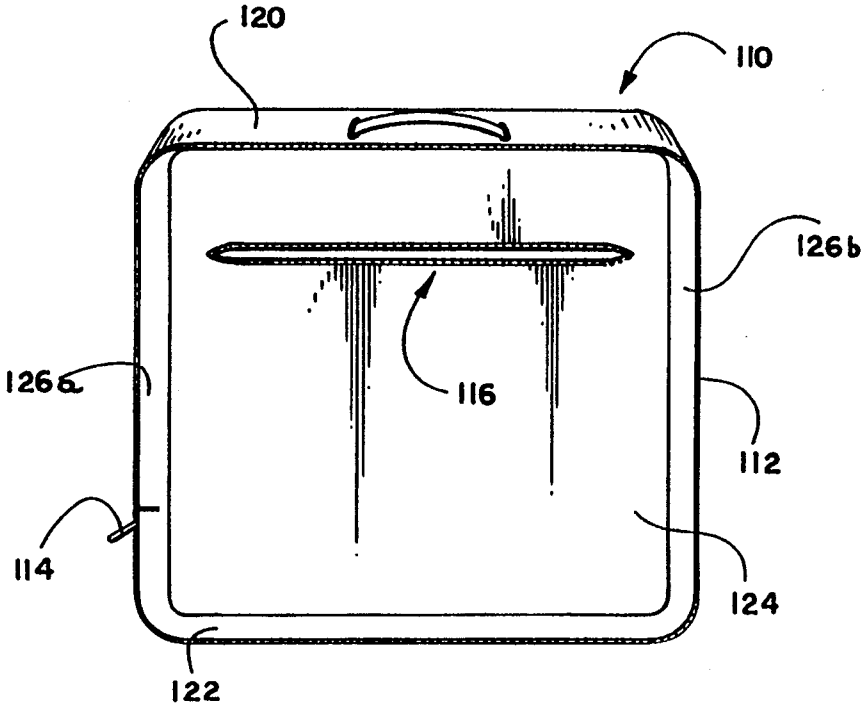
FIG. 6 is a rear view of the pocket assembly.

FIG. 6 is a rear view of a pocket assembly 110 that may be attached to the garment bag 16 in the present invention. If the wheeled assembly 60 is not mounted on the garment bag 16, zipper teeth 100 on the garment bag 16 (FIG. 5) are not occupied. Zipper teeth 112 circumscribing the interior open face of the pocket assembly 110 correspond to the zipper teeth 100, allowing the pocket assembly 110 to be mounted and affixed on the garment bag 16. Fastener 114 is utilized to connect zipper teeth 100 and 112, as is familiar to those skilled in the art.

Pocket assembly 110 is constructed of the same material as the garment bag 16. The pocket assembly 110 has a top surface 120, bottom surface 122, front surface 124 and side surfaces 126*a* and *b*. Pocket assembly 110 is constructed similarly to the wheeled assembly 60, except no wheel and handles are on the pocket assembly 110.

A zippered opening 116 allows the traveler to access the interior of the pocket assembly 110 when the pocket assembly 110 is affixed to the garment bag 16. Zippered opening 90 (FIG. 5) may be closed when the pocket assembly 110 is affixed to the garment bag 16.

During transport, the wheeled assembly 60 is affixed to the front of the garment bag 16. The garment bag 16 stands on its edges and on the wheels under the wheeled assembly when folded. Stiffeners 52 and 53 in the garment bag 16, and the stiffener frame 68 in the wheeled assembly 60, provide a frame-like structure that greatly limits wrinkling of the garments in the rolling garment bag 10 during transport. Thus, the basic structure of a garment bag for carrying formal clothes is retained. Additionally, portability is enhanced through provision of a wheeled assembly.

While this invention is described in detail with particular reference to the preferred embodiment thereof, it will be understood that other variations and modifications can be made without departing from the spirit and scope of the invention as defined in the appended claims.

I claim:

1. A rolling garment bag comprising:

a garment bag including opposing top and bottom panels, opposing side walls, and opposing front and rear panels, said top and bottom panels and said side walls being joined to said rear panel to define an elongate garment storage space, said rear panel joined to one of said side walls and including zipper teeth for detachably connecting to zipper teeth on the other side wall and said top and bottom panels to enclose said garment storage space, and wherein each said front panel and said rear panel includes an upper region and a lower region;

a first U-shaped rigid member affixed to said top panel and extending partially down said side walls;

a second U-shaped rigid member affixed to said bottom panel and extending partially up said side walls;

first zipper teeth circumscribing the outer portion of said lower region on said front panel;

an assembly, including a front surface, a top surface, a bottom surface and two side surfaces forming a substantially box-shaped structure;

second zipper teeth circumscribing at least a portion of said assembly, said second zipper teeth capable of being fastened to said first zipper teeth, so that said assembly is detachably removable from said garment bag;

a rigid frame circumscribing said side surfaces and said top and bottom surfaces on the interior of said assembly;

two wheels depending from said assembly and protruding below said garment bag;

a pair of tubes extending upward from said bottom surface to the top surface of said wheeled assembly; and a U-shaped handle, said U-shaped handle including two depending members telescoping upwardly from said tubes, whereby said garment bag may be rolled on said wheels when said handle is pulled.

2. A rolling garment bag as recited in claim 1 further comprising:

a pocket, including a front surface, a top surface, a bottom surface, and two side surfaces, said top surface, bottom surface, and two side surfaces joined to said front surface to form a substantially box-shaped structure; and third zipper teeth on said pocket capable of being fastened to said first zipper teeth, so that said pocket is detachably removable from said garment bag when said assembly is not connected to said garment bag.

3. A rolling garment bag comprising:

a rear panel;

a pair of opposing side walls and opposing top and bottom panels joined to said rear panel to define an elongate, rectangular garment storage space having an open face opposing said rear panel;

a front panel;

means for joining said front panel to one of said side walls:

means for detachably connecting said front panel to the other of said side walls and said top and bottom panels to close said open face and form a garment bag;

an assembly, including a front surface, a top surface, a bottom surface, and two side surfaces joined to form a substantially box-like structure;

first zipper teeth circumscribing at least part of said assembly;

second zipper teeth on said rear panel, said second zipper teeth being of a shape so as to be fastenable to said first zipper teeth to thereby detachably affix said assembly to said garment bag;

two wheels depending from said bottom surface of said assembly and extending below said garment bag when said assembly is affixed to said garment bag; and a handle on one of said garment bag and said assembly, whereby said garment bag and assembly may be rolled on said wheels when said handle is pulled.

4. A rolling garment bag as recited in claim 3 further comprising a rigid frame affixed to said side surfaces, said top surface and said bottom surface of said assembly, and wherein said two wheels are affixed to said rigid frame.

5. A rolling garment bag as recited in claim 4 further including: p1 a first U-shaped rigid member affixed to said top panel and extending partially down said side walls of said garment bag; and a second U-shaped rigid member affixed to said bottom panel and extending partially up said side walls of said garment bag, said first U-shaped member and said second U-shaped member not being in physical contact with each other, whereby said garment bag is foldable along an axis extending between said side walls generally midway between said top and bottom panels, and wherein said garment bag remains upright and is supported by said two U-shaped members when folded and resting on said top and bottom panels.

6. A rolling garment bag as recited in claim 4 further including:

a support plate integrally formed and protruding outwardly from the bottom surface of said assembly; and a zippered opening in said garment bag for receiving said support plate when said garment bag and said assembly are affixed together.

7. A rolling garment bag as recited in claim 3 further including a pocket assembly, including a front surface, a top surface, a bottom surface and two side surfaces forming a substantially box-like structure, said pocket assembly including third zipper teeth of a size and shape so as to be fastenable to said second zipper teeth on said garment bag, whereby said pocket assembly may be affixed to said garment bag when said assembly is not affixed to said garment bag.

8. A rolling garment bag comprising:

a garment bag including opposing top and bottom panels, opposing side walls, and opposing front and rear panels, said top and bottom panels and said side walls being joined to said rear panel to define an elongate garment storage space, said front panel joined to one of said side walls and means for detachably connecting said front panel to the other side wall and said top and bottom panels to enclose said garment storage space, and wherein each said front panel and said rear panel includes an upper region and a lower region;

a first U-shaped rigid member affixed to said top panel and extending partially down said side walls;

a second U-shaped rigid member affixed to said bottom panel and extending partially up said side walls;

first zipper teeth circumscribing the outer portion of said lower region on said rear panel;

an assembly, including a front surface, a top surface, a bottom surface and two side surfaces forming a substantially box-shaped structure;

second zipper teeth circumscribing at least a portion of said assembly, said second zipper teeth capable of being fastened to said first zipper teeth, so that said assembly is detachably removable from said garment bag;

a rigid frame circumscribing said side surfaces and said top and bottom surfaces on the interior of said assembly;

two wheels depending from said assembly and protruding below said garment bag; and a handle affixed to one of said garment bag and said assembly.

* * * * *